US005702126A

United States Patent [19]

Engel

[11] Patent Number: 5,702,126

[45] Date of Patent: Dec. 30, 1997

[54] MAGNETIC BOOK AND METHOD OF FORMING SAME

[76] Inventor: Peter H. Engel, 144 N. Robertson Blvd., Los Angeles, Calif. 90048-3102

[21] Appl. No.: 500,537

[22] Filed: Jul. 11, 1995

[51] Int. Cl.[6] ..... B42D 1/00; B42D 3/00; B42F 11/03

[52] U.S. Cl. ..... 281/29; 281/27.3; 281/DIG. 1; 281/45; 402/503

[58] Field of Search ..... 281/45, 29, 35, 281/37, 3.1, 27.3, 36, DIG. 1; 402/503; 24/303; D19/26; 206/818

[56] References Cited

U.S. PATENT DOCUMENTS

| | | | |
|---|---|---|---|
| D. 292,598 | 11/1987 | Anastos . | |
| D. 292,599 | 11/1987 | Anastos . | |
| D. 302,699 | 8/1989 | Popat et al. | D19/26 |
| D. 304,343 | 10/1989 | Popat et al. . | |
| D. 321,211 | 10/1991 | Moor . | |
| D. 323,680 | 2/1992 | Fankhauser . | |
| 2,497,332 | 2/1950 | Teetor | 402/503 |
| 2,784,757 | 3/1957 | Bosca et al. | 402/503 |
| 3,831,832 | 8/1974 | Gray | 206/818 X |
| 4,373,629 | 2/1983 | Ulin et al. | 206/818 X |
| 4,586,729 | 5/1986 | Beyerian | 281/45 X |
| 4,588,209 | 5/1986 | Zebrowski et al. | 281/45 |
| 4,600,346 | 7/1986 | Podosek | 281/35 X |
| 4,620,725 | 11/1986 | Maehashi | 402/503 X |
| 4,632,250 | 12/1986 | Ueda et al. | 206/818 X |
| 4,676,527 | 6/1987 | Palmer | 281/30 X |
| 4,819,963 | 4/1989 | Wolski . | |
| 4,886,299 | 12/1989 | Ducorday | 281/35 X |
| 4,928,823 | 5/1990 | Campbell | 206/818 X |
| 5,088,602 | 2/1992 | Heyderman et al. | 206/818 X |
| 5,092,630 | 3/1992 | Ostrowski | 281/35 X |
| 5,328,206 | 7/1994 | Scott | 281/38 |
| 5,538,132 | 7/1996 | Propp et al. | 206/818 X |

FOREIGN PATENT DOCUMENTS

| | | | |
|---|---|---|---|
| 743967 | 1/1933 | France | 206/818 X |
| 1451961 | 9/1966 | France | 281/DIG. 1 |
| 2141497 | 3/1973 | Germany | 281/DIG. 1 |
| 356782 | 10/1961 | Switzerland | 281/DIG. 1 |
| 617186 | 2/1949 | United Kingdom | 206/818 X |

*Primary Examiner*—Frances Han

*Attorney, Agent, or Firm*—Fattibene and Fattibene; Arthur T. Fattibene; Paul A. Fattibene

[57] ABSTRACT

This disclosure is directed to a miniature book construction in which one of the book covers includes a permanent magnet whereby the book can be readily affixed to a magnetically attractive surface. The book construction includes a cover jacket formed of a foldable material in which the magnet forming an end cover is adhesively secured to the cover jacket opposite a rigid blank defining the other cover, the ends of the jacket being reversely folded over the ends of the respective covers, with the bound pages of the book secured between the opposed covers by adhesively securing the opposed end most pages to the inside of the adjacent covers. Alternate embodiments may include utilizing a permanent magnet in each of the respective covers whereby the poles of the magnet may be positioned to either attract or repel so that the book may be maintained in a normally closed or open position depending upon the relationship of the poles of the respective magnets included in the book covers.

12 Claims, 2 Drawing Sheets

MAGNETIC BOOK AND METHOD OF FORMING SAME

FIELD OF THE INVENTION

The present invention relates generally to books, but especially to a book having a permanent magnet included in one of the book covers so that it can easily be displayed upon a metallic surface, and more particularly to a miniature book which can function as a useful tool for posting notes onto a refrigerator door, metallic bulletin board, and the like, and at the same time contain useful information such as household hints, sayings, quotations, poems and the like, and a method of forming the book.

BACKGROUND OF THE INVENTION

Heretofore, various efforts have been made to provide various holders for posting notes onto various metallic surfaces, such as metallic bulletin boards, refrigerator doors and the like. Generally, such holders embodied various ornate designs comprised of small inanimate and simulated animated objects such as fruit, dogs, flowers, which included a small permanent magnet by which the holder is attached and held onto a metallic surface. However, such holders are very limited in function, viz. To function as a pleasing holder for securing a note to a metallic surface.

Also it is to be noted that books are conventionally stored and displayed on shelves. Placement of books on shelves, while convenient, permit only the end of the book or binder to be visible. Such displayed books limit the amount of visible information, as well as making it difficult to locate a desired book. Additionally, in order to view the book, the book must be removed from the shelf.

SUMMARY OF THE INVENTION

The present invention includes a book construction which can be miniaturized in size wherein at least one of its covers includes a permanent magnet by which the book is rendered magnetically attracted to a magnetically attractive surface. This is attained by providing a flat sheet of material generally rectangular in shape, to which there is adhesively secured a front cover blank, a rear cover blank and intermediate therebetween a book end blank. Attached to at least one of the cover blanks is a permanent magnet. The marginal portions of the flat sheet material are reversibly folded about the adjacent edges of the front cover, rear cover and book end blanks to form an integral book cover. Disposed between the front and rear cover blanks are a series of pages bound together whereby the first and last pages of the series of bound pages are adhesively secured to the inside of the front and rear cover blanks. The arrangement is such that the miniature book is readily detachably connected to a magnetically attractive surface by the permanent magnet included in one of the book covers. In miniature size, the magnet book described can also function as a holder for a note, bill, and the like, to a refrigerator door. It will be understood that the pages of the book may contain suitable text, e.g. household hints, first aid information, recipes, quotations, sayings, jokes and other informative and/or amusing material.

The invention is also applicable for use in displaying and/or storing small and/or regularly sized books in a pleasing display at any convenient location that is readily available to the public, e.g. on a counter space, corner rack, or adjacent a check-out counter to attract a consumer's attention and to enhance impulse buying.

Another object of the present invention is to provide a book that is readily displayed in a new and novel manner.

It is a further object of the present invention to provide a book that can be readily displayed with increased visibility.

It is yet another object of the present invention that the book can be amusingly displayed in any convenient location.

Another object of the present invention that the book can be easily removed and replaced onto its supporting surface.

An object of this invention is to provide a novel book construction that can be detachably secured to a magnetically attractive surface.

An object of this invention is to provide a miniature book which can function as a holder for securing a note or the like onto a metallic surface and at the same time include other useful information that can be of value in a given situation.

Another object is to provide a book having a permanent magnet included in at lease one of the book covers whereby the book cover can be secured to a ferrous metallic surface whereby access may be had to the text contained on the pages of the book.

Another object is to provide for a miniature book novelty having a magnet cover by which the book is attracted to and supported upon a ferrous metallic surface such as a refrigerator door.

Another object is to provide for a book construction that will permit the books to be more visibly displayed, in which the book can be quickly located and which will attract greater attention.

Another object is to provide novel book construction whereby it can be readily available for reference without having to remove it from a shelf.

Another object is to provide a method of constructing a magnetic book which is simple, inexpensive and positive in operation.

A feature of the present invention resides in the manner in which a permanent magnet is incorporated in at least one of the covers of the book.

Another feature of the invention resides in the manner in which the book cover is uniquely formed to include a permanent magnet whereby the book is rendered magnetically attracted to a metallic surface.

DETAILED DESCRIPTION

Figure 1:
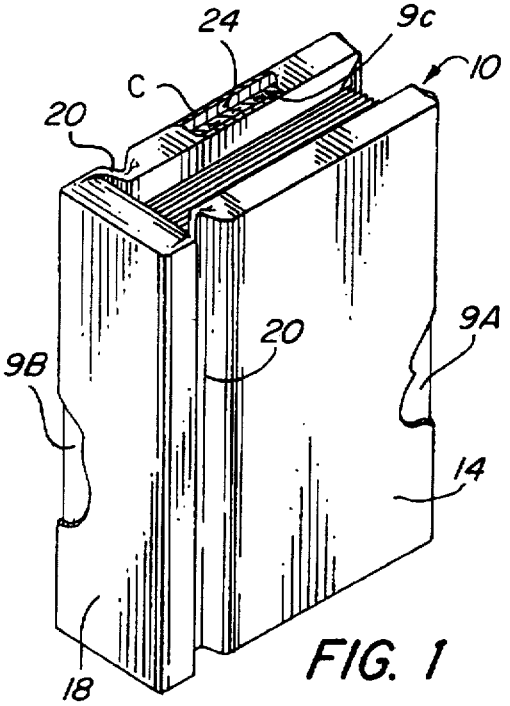
FIG. 1 is a perspective view of a closed book of the present invention, having portions broken away.
Figure 2:
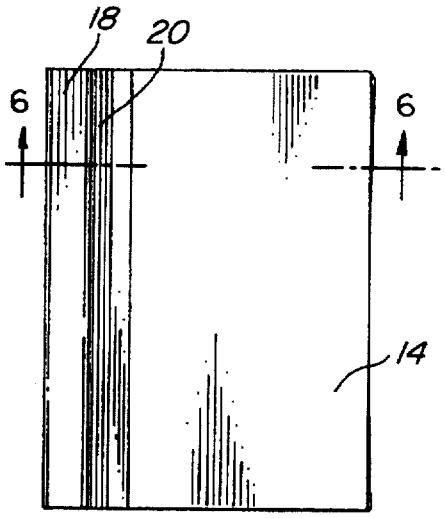
FIG. 2 is a side elevational view of the present invention.
Figure 5:
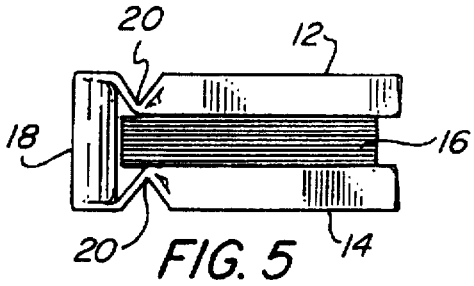
FIG. 5 is a top elevational view of the present invention.
Figure 3:
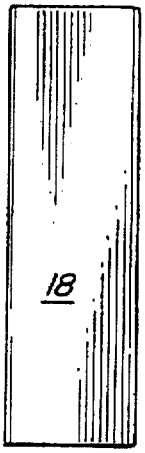
FIG. 3 is a back elevational view of the present invention.
Figure 4:
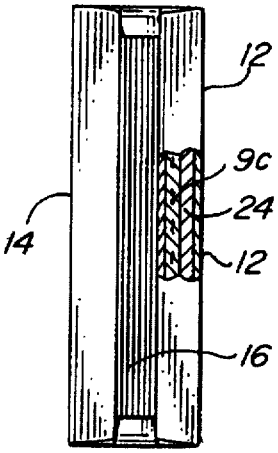
FIG. 4 is a front elevational view of the present invention.
Figure 1A:
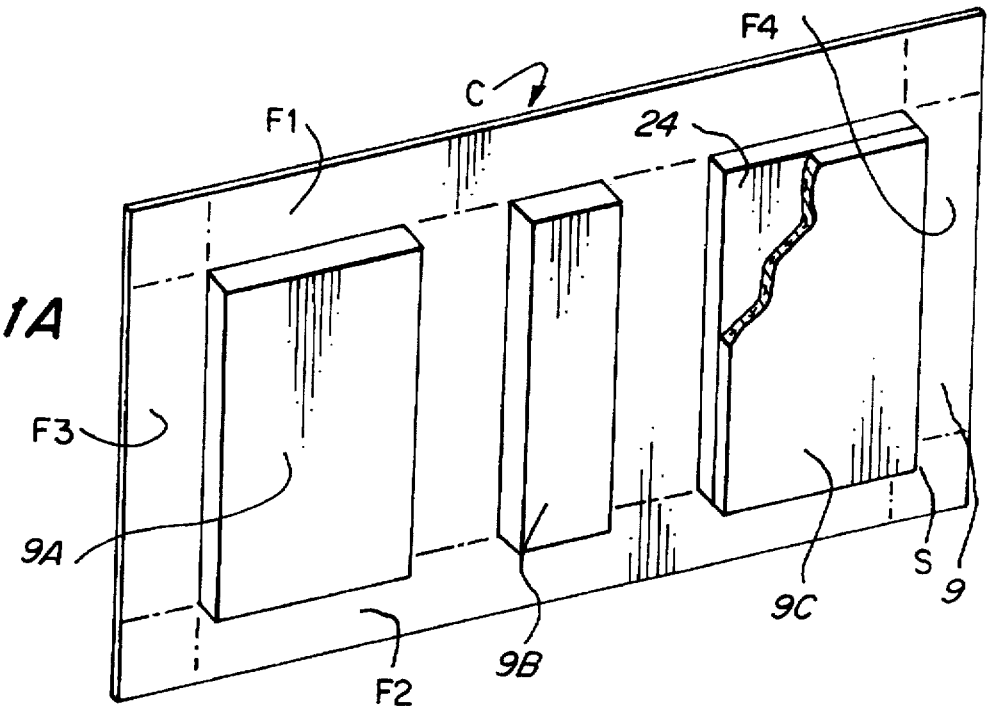
FIG. 1A is a plan view illustrating the initial forming of the book cover utilized in the present invention.
Figure 1B:
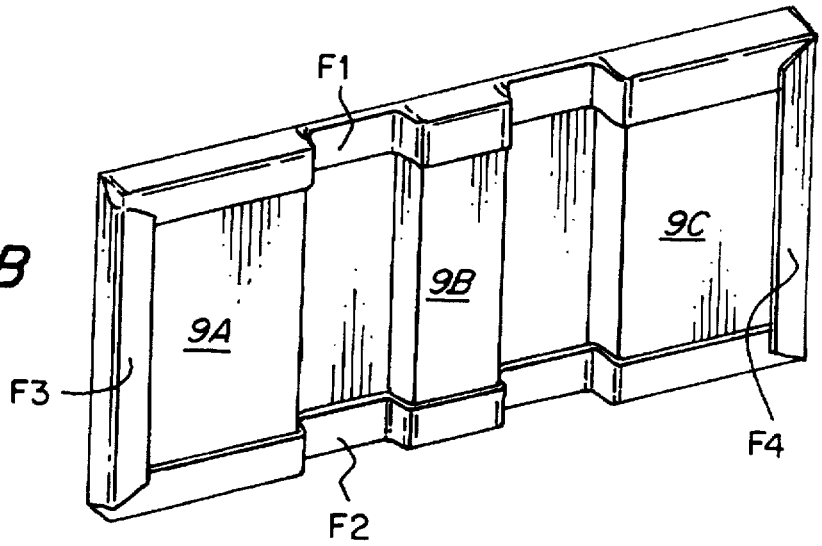
FIG. 1B is a plan view illustrating an intermediate stage in the formation of the book cover of the present invention.

Referring to the drawings, there is illustrated in FIGS. 1A and 1B the plan views relating to the formation of the miniature book 10 embodying the present invention. As shown in FIG. 1A, the cover jacket C is formed by a blank 9 of thin sheet foldable material, e.g. plastic, paper, or fabric which is generally rectangular in shape. The surface S of blank 9 may be coated with a with a layer of a suitable pressure sensitive adhesive. Adhesively secured in spaced relationship onto the surface S of the jacket blank 9 is a rectangular planar permanent magnet 24 sized to define the back cover 12 of the book 10. Also secured to surface S of the blank 9 is a blank of rigid material 9A, e.g. cardboard, generally equal in size to that of the planar magnet 24 to define the front cover 14 as will be herein described. Secured to blank 9 in spaced relationship between the magnet 24 and the rigid blank of material 9A is a relatively narrow blank 9B to define the book end 18. Blank 9B is also formed of a rigid material, e.g. cardboard. In the illustrated embodiment, the thickness of the blanks 9A and 9B are substantially equal, and have a thickness substantially twice that of the permanent magnet 24. Superimposed onto the magnet 24 and substantially coincidental therewith and adhesively secured thereto is a blank of rigid cardboard or the like 9C. The combined thickness of the magnet 24 and blank 9C is substantially equal to the thickness of blank 9A.

As shown in FIG. 1A, the jacket blank 9 has a length and width which is greater than the length and width of the blanks 9A, 9B and 9C to provide circumscribing marginal flaps $F_1$, $F_2$, $F_3$ and $F_4$, which are arranged to be reversely folded and adhesively secured to the respective rigid blanks 9A, 9B and 9C as best seen in FIG. 1B. The arrangement is such that an integral book cover is formed to define a rear cover 12 and front cover 14 hingedly connected by folds 20—20 relative the book end 18, defined by blank 9B. The spacing between the magnet 24 and blanks 9A and 9C defining the covers 12 and 14 is sufficient to provide an accordion fold 20—20 to permit the hinging of the front and rear covers 14 and 12 respectively relative to the book end 18.

Figure 6:
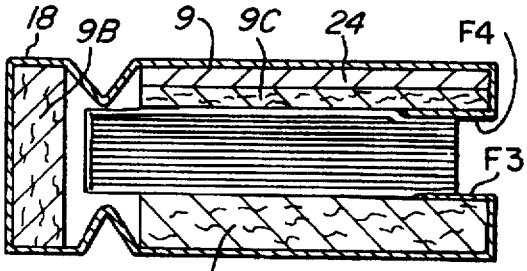
FIG. 6 is a cross sectional view taken along lines 6—6 in FIG. 2 of the present invention.
Figure 7:
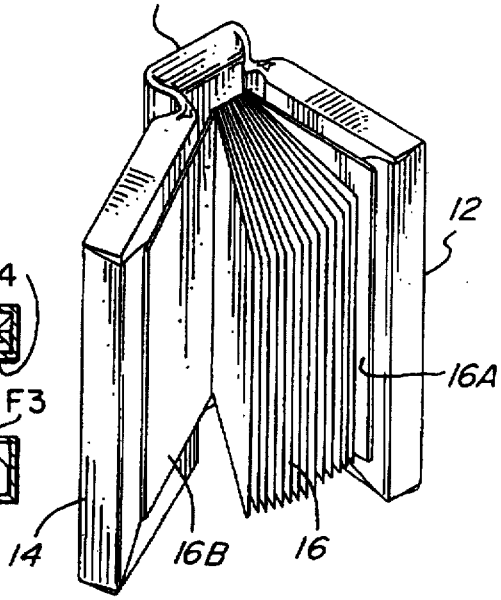
FIG. 7 is a perspective view of an open book of the present invention.

Secured between the rear and front covers 12 and 14 are the book pages 16. As best seen in FIGS. 6 and 7, the book pages 16 comprise a plurality of pages which are suitably bounded together at one end. The bound book pages 16 are secured between the front and rear covers 14 and 12 by adhesively securing the end most page 16A and 16B to the inside surface of the adjacent rear cover 12 and front cover 14 respectively.

It will be understood that the respective pages 16 are provided with suitable text conforming to any desired theme, e.g. famous quotations, household hints, recipes, first aid instructions, jokes, poems and the like. In miniature form, the book may be formed as small as one to two inches in size. However, it will be understood that the construction described may be embodied in much larger sized books.

In its miniature form, the book makes an ideal and novel means for use as a tool or novelty for posting notes, pictures and the like onto a refrigerator door, in addition to being useful for the text contained in the book. Also, the described construction provides a novel means whereby the book 10 may be displayed at a point of sale by attachment to a metal surface as a result of the magnetic attraction provided by the permanent magnet contained in the rear cover 12 of the book 10. Thus, the permanent magnet included in the cover of the book 10 enables the book to be marketed in a unique manner, obviating the need of book racks or shelves. In miniature form, the book construction described provides an interesting and pleasing novelty as well as an informative and amusing article of commerce.

Figure 8:
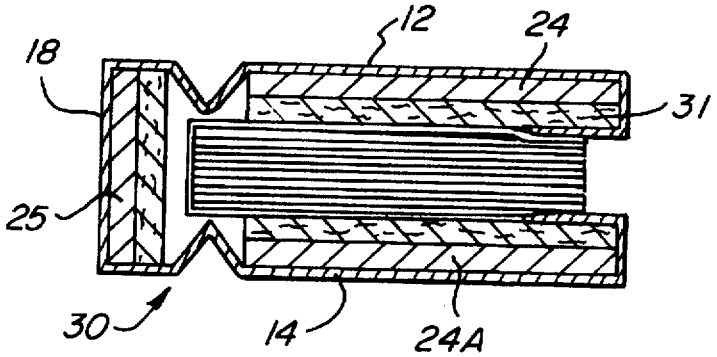
FIG. 8 illustrates a sectional view of a modified form of the invention.

As an alternate construction, see FIG. 8. A permanent magnet 24, 24A may be included in both the front cover 14 and the rear cover 12 of the book 30. In the alternate form of the invention, the poles of the respective magnets 24, 24A in the respective covers 12, 14 of book 30 may be positioned so that the magnets will either attract or repel one another. Thus, in the alternate form of the invention, if the respective permanent magnets 24, 24A included in the respective front and rear covers are disposed to repel one another, the book 30 is maintained in a normally opened position. If the opposed magnets 24, 24A included in the opposed covers of the book 30 are disposed to attract one another, the book 30 is normally maintained in a closed position.

A further alternate modification is to locate the magnet 25 in the book end portion 18, which is illustrated in FIG. 8.

The use of the magnetic material in both the back cover 12 and the front cover 14 permit book 30 to be attached onto a metal magnetic surface so that either the front or back of the book is displayed. For example, when the magnetic material is placed only in the back cover 12, as in FIG. 1, the front cover of the book is always displayed when the back cover 12 is attached to a metal surface. If the book end 18 contains a magnet, the book can be attached to a magnetic surface in a position to allow one to leaf through the pages. Also, when a magnetic material is contained in the book end 18, the magnetic field triggered by the magnetic material in the other portions of the book may be enhanced, thereby increasing the holding power of the book on a metal surface.

An additional feature of placing a magnetic material in both the front cover 14 and the back cover 12 is that by selectively positioning the different poles of the magnet, the book 10 can be configured so as the front and back covers attract each other, keeping the book closed, or repel each other, forcing the book to remain open. For example, when the magnetic material in the back cover 12 is positioned such that a north pole is at the top of the book and a south pole is at the bottom of the book, and the magnetic material in the front cover 14 is positioned so that the north pole is at the bottom of the book and the south pole is at the top of the book, the opposing poles in the covers will be opposite each other and thereby attract, holding the book closed. Conversely, if the magnetic material in the back cover is positioned so that the north pole is at the top of the book and the south pole is at the bottom of the book and the magnetic material in the front cover 14 is positioned similarly such that the north pole is at the top of the book and the south pole is at the bottom of the book, like poles will be opposing each other in the front cover 14 and the back cover 12, resulting in the magnetic material in the two covers repelling each other, thereby forcing the book to remain open. It will also be noted in FIG. 8 that superimposed on the respective magnets is a sheet of rigid non-metallic material, e.g. cardboard 31, similar to that described with respect to FIG. 1.

It should readily be appreciated that the book of the present invention can easily be displayed on any metal surface such as a refrigerator door. Additionally, the book can be more easily displayed at point of sale locations, e.g. at the counters near check-outs. Also, the book can be readily placed and/or removed quickly and easily, making a handy reference.

From the foregoing, it will be apparent that a relatively simple method is provided for forming a book construction which includes as a portion thereof a permanent magnet whereby the book may be detachably connected to a suitable magnetic attractive surface.

While the present invention has been described with respect to various embodiments, various modifications may be made without departing from the spirit and scope of this invention.

What is claimed:

1. A book construction comprising:

a sheet of readily foldable material for defining a cover jacket, an adhesive coating formed on a planar surface of said sheet of material, a planar permanent magnet sized to define a cover adhesively secured to a portion of said coated surface of said sheet of material, a cover blank sized to define an opposite cover adhesively secured to said coated sheet of material opposite said permanent magnet and spaced therefrom, said cover blank and planar permanent magnet, each having outer edges, said sheet of material having a length and width greater than the combined length of said cover blank and magnet and the width of said cover and magnet, and said sheet of material having marginal flaps circumscribing said outer edges of said cover blank and planar permanent magnet adhesively secured to said sheet of material, said marginal flaps being reversely folded about said outer edges of said cover blank and planar permanent magnet to form an integral hingedly connected front and rear cover, and a series of bound pages disposed between said front and rear covers, said series of pages being bounded together along one edge thereof, said bound pages including opposed end most pages, said end most pages being adhesively secured to the adjacent front and rear covers for supporting said bound pages between said covers.

2. A book construction as defined in claim 1 and including a second cover blank superimposed onto said planar permanent magnet.

3. A book construction as defined in claim 1 and including a rigid end blank adhesively secured to said coated surface of said sheet material, said end blank being disposed between said cover blank and said planar permanent magnet in spaced relationship therebetween to define a fold between each of said covers and said book end.

4. A book construction as defined in claim 1 and including a second permanent magnet disposed opposite said planar permanent magnet, said second permanent magnet being disposed between said cover blank and said coated sheet of material.

5. A book construction as defined in claim 4 wherein the poles of said first and second magnets are disposed to repel one another.

6. A book construction as defined in claim 4 wherein the poles of said planar permanent magnet and said second permanent magnet are disposed to attract one another.

7. A method for constructing a book comprising the steps of forming a cover jacket from a planar sheet of readily foldable material which is generally rectangular in shape, coating one surface of said planar sheet with a layer of pressure sensitive adhesive, adhesively securing to said coated surface a planar permanent magnet to a portion of said sheet and sized to define a book cover, adhesively securing to said coated surface opposite said permanent magnet a rigid cover blank similar in length and width to said permanent magnet in spaced relationship thereto to define the other book cover, forming said cover jacket with a length and width greater than the length and width of said oppositely disposed magnet and rigid blank to define a circumscribing marginal flap, reversely folding the circumscribing marginal flap onto the adjacent ends of said permanent magnet and opposed rigid blank defining the opposed book cover, binding together a series of pages along an end portion thereof, and adhesively attaching the end most pages of said bound pages to the inside portion of the adjacent book covers.

8. A method of constructing a book as defined in claim 7 and including the step of adhesively securing a rigid end blank to said coated surface of said cover jacket between said magnet and said rigid cover blank and spaced therefrom.

9. A method of constructing a book as defined in claim 7 and including the step of superimposing a second cover blank onto said permanent magnet.

10. A method of constructing a book as defined in claim 7 and including the steps of securing a second magnet opposite said first mentioned magnet so as to include a magnet in each of the opposed book covers.

11. A method of constructing a book as defined in claim 10 and including the step of disposing the poles of said respective magnets so as to repel one another.

12. A method of constructing a book as defined in claim 11 and including the step of disposing the poles of the respective magnets to attract one another.

* * * * *